US010276099B2

(12) United States Patent
Lee et al.

(10) Patent No.: US 10,276,099 B2
(45) Date of Patent: Apr. 30, 2019

(54) ORGANIC LIGHT EMITTING DIODE DISPLAY AND METHOD FOR DRIVING THE SAME

(71) Applicant: LG DISPLAY CO., LTD., Seoul (KR)

(72) Inventors: Joonhee Lee, Seoul (KR); Heejung Hong, Seoul (KR); Dongwon Park, Goyang-si (KR); Jongmin Park, Anyang-si (KR); Yongchul Kwon, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 194 days.

(21) Appl. No.: 15/392,721

(22) Filed: Dec. 28, 2016

(65) Prior Publication Data

US 2017/0193913 A1 Jul. 6, 2017

(30) Foreign Application Priority Data

Dec. 30, 2015 (KR) ..... 10-2015-0190434

(51) Int. Cl.
*G09G 3/3258* (2016.01)
*G09G 3/3233* (2016.01)
*G09G 3/20* (2006.01)

(52) U.S. Cl.
CPC ..... *G09G 3/3258* (2013.01); *G09G 3/3233* (2013.01); *G09G 3/2025* (2013.01); *G09G 2300/04* (2013.01); *G09G 2310/08* (2013.01); *G09G 2320/0223* (2013.01); *G09G 2320/043* (2013.01)

(58) Field of Classification Search
CPC ..... G09G 3/2022; G09G 3/2025; G09G 2310/08; G09G 2320/0223; G09G 2320/043; G09G 2320/045
USPC ..... 345/691–693
See application file for complete search history.

(56) References Cited

U.S. PATENT DOCUMENTS 8,441,417 B2 * 5/2013 Uchino ..... G09G 3/2011 345/76
8,711,136 B2 * 4/2014 Park ..... G09G 3/3233 345/204
2015/0042703 A1 * 2/2015 Chaji ..... G09G 3/3233 345/694
2015/0054862 A1 * 2/2015 Kaplan ..... G09G 3/2022 345/691

* cited by examiner

*Primary Examiner* — Michael Pervan
(74) *Attorney, Agent, or Firm* — Dentons US LLP

(57) ABSTRACT

Disclosed is an organic light emitting diode (OLED) display that includes a display panel including a plurality of gate lines and a plurality of data lines crossing each other to define a plurality of pixels, each pixel including a driving transistor, a switching transistor, an OLED and a storage capacitor; a timing controller that receives pixel data of an input image and timing signals and time-divides a period of one frame into at least a driving sub-frame and a compensation sub-frame based on one or more of the timing signals; and a display panel driver that converts the pixel data into data voltages and supplies the data voltages to the plurality of data lines during the driving sub-frame, and that adjusts compensation gray levels of the plurality of pixels or compensation duties of the plurality of pixels based on a luminance map, which contains information on a luminance deviation for each pixel with respect to a same gray level, during the compensation sub-frame.

17 Claims, 13 Drawing Sheets

(A)

| | | | |
|---|---|---|---|
| 100 (P1) | 70 (P2) | 85 (P3) | 95 (P4) |
| 75 (P5) | 90 (P6) | 100 (P7) | 80 (P8) |
| 85 (P9) | 100 (P10) | 80 (P11) | 70 (P12) |
| 95 (P13) | 75 (P14) | 85 (P15) | 100 (P16) |

(Unit:nit)

(B)

(C)

| | | | |
|---|---|---|---|
| 70 (P1) | 70 (P2) | 70 (P3) | 70 (P4) |
| 70 (P5) | 70 (P6) | 70 (P7) | 70 (P8) |
| 70 (P9) | 70 (P10) | 70 (P11) | 70 (P12) |
| 70 (P13) | 70 (P14) | 70 (P15) | 70 (P16) |

(Unit:nit)

(D)

| | | | |
|---|---|---|---|
| 100 (P1) | 100 (P2) | 100 (P3) | 100 (P4) |
| 100 (P5) | 100 (P6) | 100 (P7) | 100 (P8) |
| 100 (P9) | 100 (P10) | 100 (P11) | 100 (P12) |
| 100 (P13) | 100 (P14) | 100 (P15) | 100 (P16) |

(Unit:nit)

FIG. 11

| Gray | Luminance(nit) |
|---|---|
| 255 | 100.0 |
| 250 | 94.6 |
| 245 | 89.4 |
| 240 | 84.4 |
| 235 | 79.6 |
| 230 | 74.9 |
| 225 | 70.4 |
| 220 | 66.1 |
| 215 | 62.0 |
| 210 | 58.1 |
| 205 | 54.3 |
| 200 | 50.6 |
| 195 | 47.2 |
| ⋮ | ⋮ |

ORGANIC LIGHT EMITTING DIODE DISPLAY AND METHOD FOR DRIVING THE SAME

This application claims the benefit of Korea Patent Application No. 10-2015-0190434 filed on Dec. 30, 2015, which is incorporated herein by reference for all purposes as if fully set forth herein.

BACKGROUND

Field of the Invention

The present disclosure relates to an organic light emitting diode display and a method for driving the same.

Discussion of the Related Art

An organic light emitting diode (OLED) display includes a plurality of organic light emitting diodes (OLEDs) capable of emitting light by themselves and has many advantages, such as fast response time, high emission efficiency, high luminance, wide viewing angle, and the like.

An OLED serving as a self-emitting element includes an anode electrode, a cathode electrode, and an organic compound layer between the anode electrode and the cathode electrode. The organic compound layer typically includes a hole injection layer HIL, a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emission layer EML and form excitons. As a result, the emission layer EML generates visible light.

An OLED display includes a plurality of pixels, each including an OLED in a matrix and adjusts the luminance of the pixel based on a gray scale of video data. Each pixel includes a driving element, for example, a driving thin film transistor (TFT) for controlling an amount of driving current flowing in the OLED depending on a voltage applied between a gate electrode and a source electrode of the driving TFT. The electrical characteristics of the OLED and the driving TFT may vary depending on their operation temperatures or amounts of deterioration. For example, an operating voltage of the OLED, a threshold voltage and a mobility of the driving TFT, etc. may change because these elements deteriorate as their driving times increase. Further, the electrical characteristics of these elements may vary due to variations in manufacturing processes. These variations in the electrical characteristics of the OLEDs and/or the driving TFTs of the pixels may result in difference in the luminance of the pixels with respect to the same video data, thereby making it challenging to display a desired image.

Also, an IR drop may be generated in the OLED display due to the line resistance of a high potential power source. Thus, a magnitude of a high potential power voltage applied to each pixel line, which is typically connected to a plurality of pixels in a horizontal direction, on the display panel may vary depending on a separation distance between the pixel line and the high potential power source and result in deviation in the luminance of the pixel line, thereby also making it challenging to display a desired image.

SUMMARY

Accordingly, the present disclosure is directed to an organic light emitting diode display and a method for driving the same. that substantially obviate one or more problems due to limitations and disadvantages of the related art.

An advantage of the present disclosure is to provide an organic light emitting display device with improved display images.

Additional advantages and features of the present disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, an organic light emitting diode (OLED) display may, for example, include a display panel including a plurality of gate lines and a plurality of data lines crossing each other to define a plurality of pixels, each pixel including a driving transistor, a switching transistor, an OLED and a storage capacitor; a timing controller that receives pixel data of an input image and timing signals and time-divides a period of one frame into at least a driving sub-frame and a compensation sub-frame based on one or more of the timing signals; and a display panel driver that converts the pixel data into data voltages and supplies the data voltages to the plurality of data lines during the driving sub-frame, and that adjusts compensation gray levels of the plurality of pixels or compensation duties of the plurality of pixels based on a luminance map, which contains information on a luminance deviation for each pixel with respect to a same gray level, during the compensation sub-frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 11 illustrates a luminance implemented in accordance with a compensation gray level;

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. Detailed description of known arts will be omitted if it is determined that the arts can mislead the embodiments of the invention.

Figure 1:
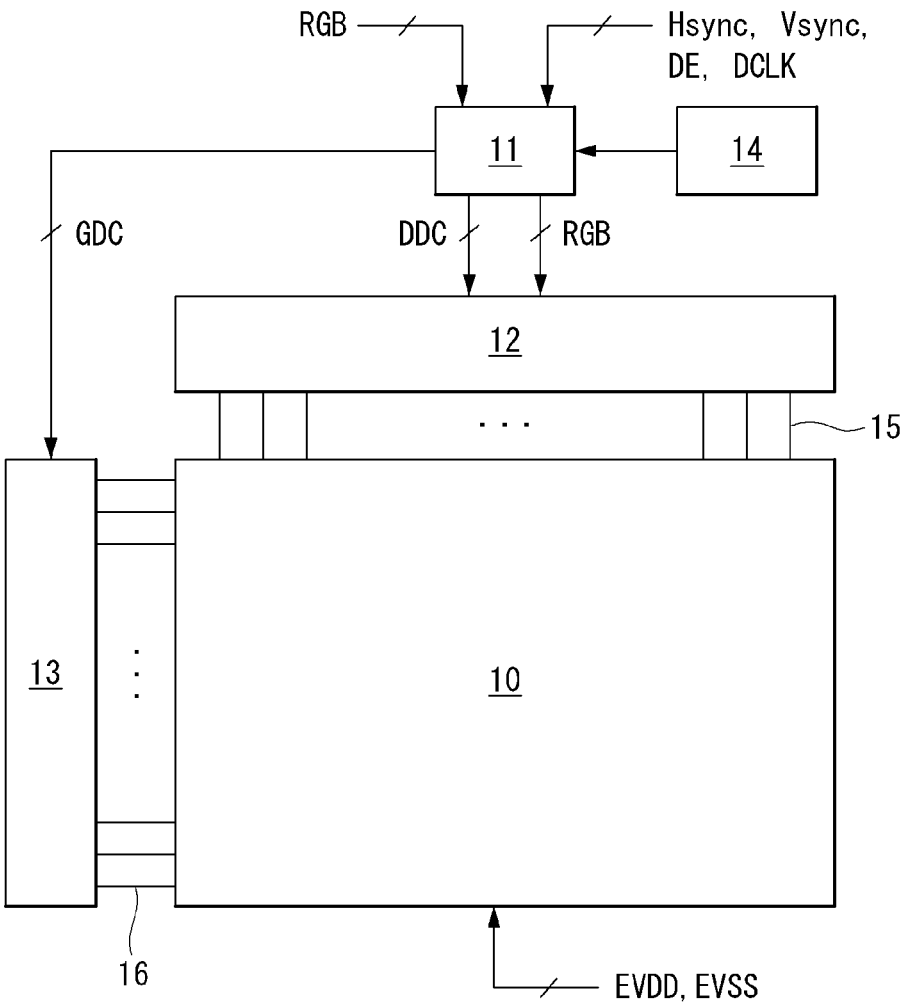
FIGS. 1 and 2 illustrate an organic light emitting diode (OLED) display according to an exemplary embodiment of the invention.
Figure 2:
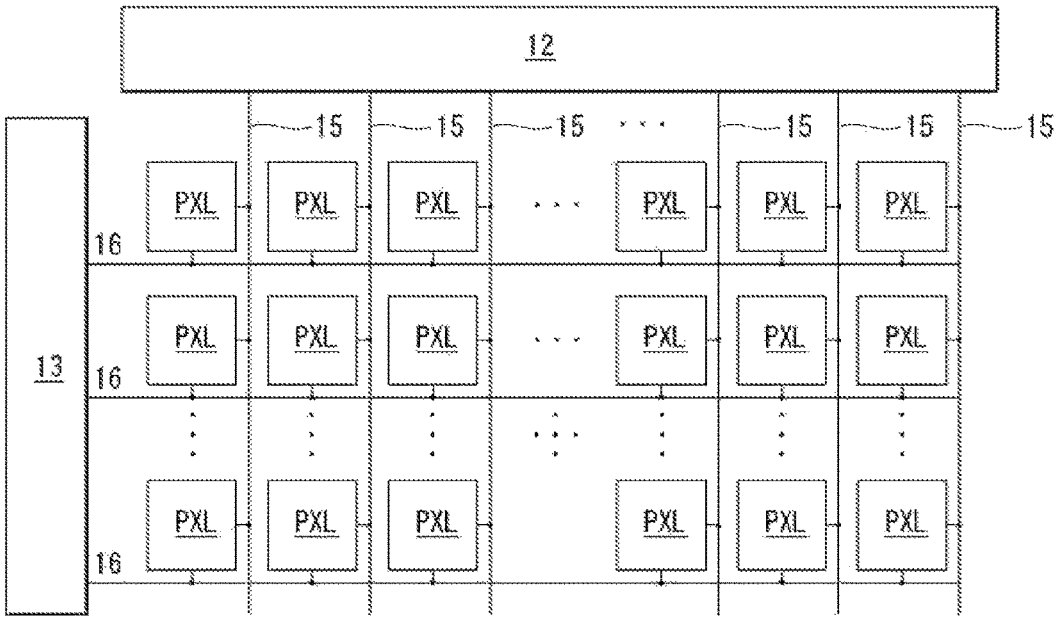
Figure 3:
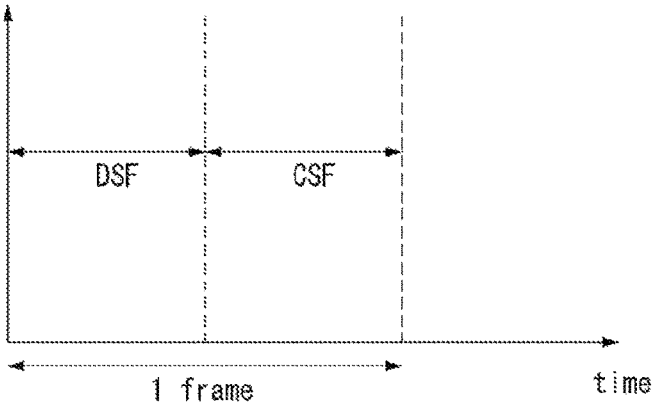
FIG. 3 illustrates that one frame is time-divided into a driving sub-frame and a compensation sub-frame in accordance with an exemplary embodiment of the invention.

FIGS. 1 and 2 illustrate an organic light emitting diode (OLED) display according to an exemplary embodiment of the invention. FIG. 3 illustrates that one frame is time-divided into a driving sub-frame and a compensation sub-frame in accordance with an exemplary embodiment of the invention.

Referring to FIGS. 1 and 2, the OLED display according to an exemplary embodiment of the invention includes a display panel 10, a display panel driver for applying pixel data of an input image to an array of pixels in the display panel 10, a timing controller 11 for controlling the display panel driver, and a memory 14 for storing a luminance map. The display panel driver includes a data driver 12 and a gate driver 13.

Figure 4A:
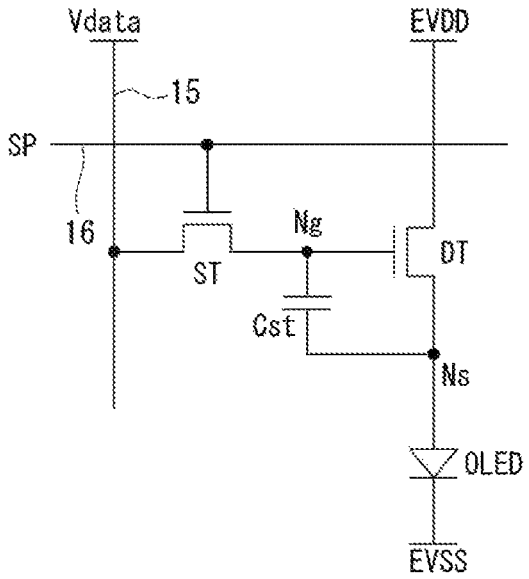
FIGS. 4A and 4B illustrate an equivalent circuit of a pixel applied to an exemplary embodiment of the invention.
Figure 4B:
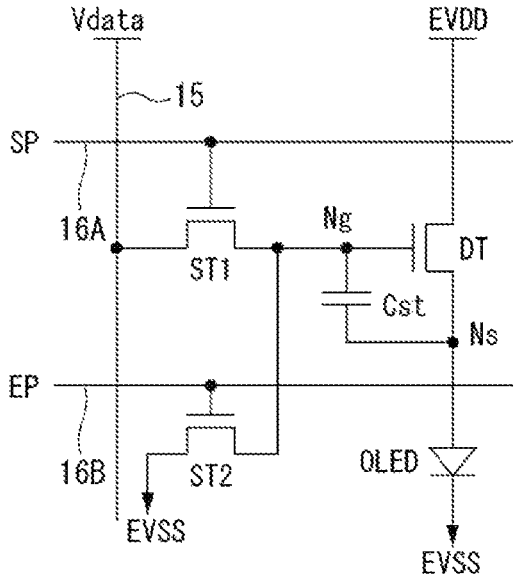

On the pixel array of the display panel 10, a plurality of data lines 15 and a plurality of gate lines 16 cross each other. The pixel array of the display panel 10 includes pixels PXL that are arranged in a matrix and display an input image. Each pixel PXL may be one of a red (R) pixel, a green (G) pixel, a blue (B) pixel, and a white (W) pixel. Each pixel PXL may include a plurality of thin film transistors (TFTs), an organic light emitting diode (OLED) and a capacitor. Each gate line 16 may include a scan control line as illustrated in FIG. 4A, or may further include an emission control line in addition to the scan control line as illustrated in FIG. 4B.

The timing controller 11 receives pixel data RGB of an input image and timing signals Vsync, Hsync, DE, and DCLK from a host system (not shown). As illustrated in FIG. 3, the timing controller 11 time-divides one frame into at least a driving sub-frame DSF and a compensation sub-frame CSF based on one or more of the timing signals Vsync, Hsync, DE, and DCLK. The driving sub-frame DSF is used to apply the pixel data RGB of the input image to the pixels PXL, and the compensation sub-frame CSF is used to compensate for a luminance deviation of each pixel. During the compensation sub-frame CSF, the timing controller 11 controls an operation of the display panel driver and adjusts compensation gray levels of the pixels PXL or compensation duties of the pixels PXL, thereby to compensate for a luminance deviation of each pixel. The timing controller 11 may refer to the luminance map stored in the memory 14 so as to adjust compensation gray levels of the pixels PXL or compensation duties of the pixels PXL.

The timing controller 11 produces a source timing control signal DDC for controlling an operation timing of the data driver 12 and a gate timing control signal GDC for controlling an operation timing of the gate driver 13 during each of the driving sub-frame DSF and the compensation sub-frame CSF based on one or more of the timing signals Vsync, Hsync, DE, and DCLK.

The timing controller 11 may supply the pixel data RGB of the input image to the data driver 12 during the driving sub-frame DSF. The timing controller 11 may supply compensation data for compensating for a luminance deviation of the pixels PXL to the data driver 12 during the compensation sub-frame CSF, thereby adjusting a compensation gray level on a per pixel basis. Further, the timing controller 11 may supply black data for compensating for a luminance deviation of the pixels PXL to the data driver 12 during the compensation sub-frame CSF, thereby adjusting a compensation gray level on a per pixel basis. Further, the timing controller 11 may control an operation of the gate driver 13 during the compensation sub-frame CSF and control a production timing of an emission control signal, thereby adjusting a compensation duty for compensating for a luminance deviation of the pixels PXL on a per pixel basis.

The timing controller 11 may supply compensation data for compensating for a luminance deviation of the pixel lines resulting from an IR drop to the data driver 12 during the compensation sub-frame CSF, thereby additionally adjusting a compensation gray level on a per pixel line basis. Further, the timing controller 11 may supply black data for compensating for a luminance deviation of the pixel lines resulting from an IR drop to the data driver 12 during the compensation sub-frame CSF, thereby additionally adjusting a compensation gray level on a per pixel line basis. Further, the timing controller 11 may control an operation of the gate driver 13 during the compensation sub-frame CSF and control a production timing of an emission control signal, thereby additionally adjusting a compensation duty for compensating for a luminance deviation of the pixel lines on a per pixel line basis.

During the driving sub-frame DSF, the data driver 12 may convert the pixel data RGB of the input image into data voltages in response to the source timing control signal DDC and output the data voltages to the data lines 15. During the compensation sub-frame CSF, the data driver 12 may convert compensation data for compensating for a luminance deviation into compensation voltages in response to the source timing control signal DDC and output the compensation voltages to the data lines 15. During the compensation sub-frame CSF, the data driver 12 may convert black data for compensating for a luminance deviation into black voltages in response to the source timing control signal DDC and output the black voltages to the data lines 15.

In the embodiment disclosed herein, the data voltages and the compensation voltages are selected within a voltage range capable of causing a current to flow between a drain electrode and a source electrode of a driving TFT and increase in proportion to gray levels. On the other hand, the black voltages indicate a voltage range that causes a current not to flow between the drain electrode and the source electrode of the driving TFT. Controlling compensation gray levels on a per pixel basis or a per pixel line basis may be implemented by controlling a size of the compensation data on a per pixel basis or a per pixel line basis during a compensation sub-frame. Controlling compensation duties on a per pixel basis or a per pixel line basis may be implemented by controlling an application timing of the black data on a per pixel basis or a per pixel line basis during the compensation sub-frame.

During each of the driving sub-frame DSF and the compensation sub-frame CSF, the gate driver 13 may produce a scan control signal in response to the gate timing control signal GDC and supply the scan control signal to the gate lines 16 (more specifically, scan control lines) in a line sequential manner. During the compensation sub-frame CSF, the gate driver 13 may additionally produce an emission control signal in response to the gate timing control signal GDC and supply the emission control signal to the gate lines 16 (more specifically, emission control lines).

In the embodiment disclosed herein, the scan control line may be commonly connected to the pixels PXL on the same pixel line. On the other hand, the emission control lines may be individually connected to all of the pixels PXL, so that compensation duties are controlled on a per pixel basis. Further, the emission control lines may be commonly connected to the pixels PXL on the same pixel line, so that compensation duties are controlled on a per pixel line basis. Controlling compensation duties on a per pixel basis or a per pixel line basis may be implemented by controlling an application timing of the emission control signal on a per pixel basis or a per pixel line basis during the compensation sub-frame.

The memory 14 stores a luminance map that contains information on a luminance deviation for each pixel corresponding to the same gray level. The luminance map may be previously measured using a luminance measuring instrument, etc. during a shipment step and may be stored. The luminance map may be updated based on a result of sensing changes in electrical characteristics of the driving TFT and the OLED after shipment. An update of the luminance map may be performed at predetermined intervals. The luminance map may further include information on a luminance deviation of each pixel line depending on a separation distance between the pixel line and the high potential power source.

FIGS. 4A and 4B illustrate an equivalent circuit of a pixel according to an embodiment of the present invention.

Referring to FIG. 4A, a pixel PXL according to an embodiment of the present invention may include an OLED, a driving TFT DT, a switching TFT ST, a storage capacitor Cst, and the like. A pixel structure illustrated in FIG. 4A may be applied to both a compensation method of FIG. 5 for adjusting a compensation gray level during the compensation sub-frame CSF and a compensation method of FIG. 6 for adjusting a compensation duty during the compensation sub-frame CSF.

An OLED has a structure in which organic compound layers, such as a hole injection layer HIL, a hole transport layer HTL, an emission layer EML, an electron transport layer ETL, and an electron injection layer EIL, are stacked. The OLED generates light when electrons and holes are combined in the emission layer EML. An anode electrode of the OLED is connected to a source node Ns, and a cathode electrode of the OLED is connected to a low potential power source EVSS.

The driving TFT DT is a driving element that makes the OLED emit light by applying a drain-to-source current of the driving TFT DT to the OLED. The driving TFT DT is connected between a high potential power source EVDD and the OLED and may produce the drain-to-source current in proportion to a data voltage Vdata or a compensation voltage applied to a gate node Ng. When a black voltage is applied to the gate node Ng of the driving TFT DT, the drain-to-source current may not be generated. A gate electrode of the driving TFT DT may be connected to the gate node Ng, and a drain electrode of the driving TFT DT may be connected to the high potential power source EVDD. A source electrode of the driving TFT DT may be connected to the source node Ns.

The switching TFT ST is turned on in response to a scan control signal SP from the scan control line 16. The switching TFT ST may supply the data voltage Vdata, the compensation voltage, or the black voltage to the gate node Ng in response to the scan control signal SP. A gate electrode of the switching TFT ST may be connected to the scan control line 16, and a drain electrode of the switching TFT ST may be connected to the data line 15. A source electrode of the switching TFT ST may be connected to the gate node Ng.

The storage capacitor Cst holds a gate-to-source voltage of the driving TFT DT for a predetermined period of time. The storage capacitor Cst is connected between the gate node Ng and the source node Ns of the driving TFT DT and holds a voltage applied to the gate node Ng.

Referring to FIG. 4B, a pixel PXL according to an embodiment of the present invention may include an OLED, a driving TFT DT, a first switching TFT ST1, a second switching TFT ST2, a storage capacitor Cst, and the like. A pixel structure illustrated in FIG. 4B may be applied to both a compensation method of FIG. 5 for adjusting a compensation gray level during the compensation sub-frame CSF and a compensation method of FIG. 6 for adjusting a compensation duty during the compensation sub-frame CSF.

Since the OLED, the driving TFT DT, and the storage capacitor Cst in FIG. 4B are substantially the same as those illustrated in FIG. 4A, a duplicative description thereof may be omitted.

The first switching TFT ST1 is turned on in response to a scan control signal SP from a scan control line 16A. The first switching TFT ST1 may supply a data voltage Vdata or a compensation voltage to a gate node Ng in response to the scan control signal SP. A gate electrode of the first switching TFT ST1 may be connected to the scan control line 16A, and a drain electrode of the first switching TFT ST1 may be connected to a data line 15. A source electrode of the first switching TFT ST1 may be connected to the gate node Ng.

The second switching TFT ST2 is turned on in response to an emission control signal EP from an emission control line 16B. The second switching TFT ST2 connects a low potential power source EVSS to the gate node Ng in response to the emission control signal EP. A gate electrode of second switching TFT ST2 may be connected to the emission control line 16B, and a source electrode of the second switching TFT ST2 may be connected to the low potential power source EVSS. A drain electrode of the second switching TFT ST2 may be connected to the gate node Ng. When the low potential power source EVSS is connected to the gate node Ng, the data voltage Vdata, that has been stored in the gate node Ng, is discharged up to the low potential power source EVSS. As a result, the driving TFT DT may not produce a drain-to-source current. The driving TFT DT may produce the drain-to-source current in proportion to a data voltage Vdata or a compensation voltage applied to the gate node Ng.

Figure 5:
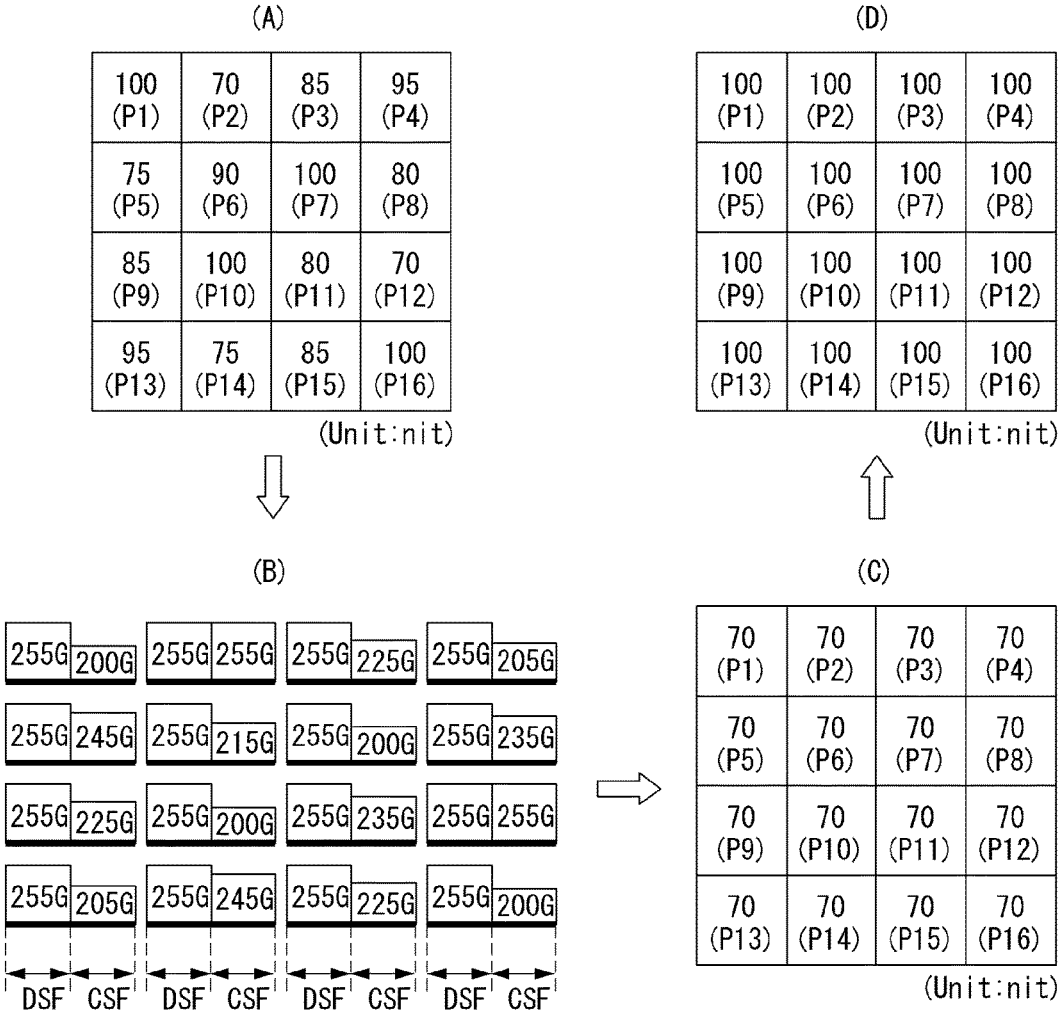
FIG. 5 illustrates an example of adjusting compensation gray levels of pixels during a compensation sub-frame to compensate for a luminance deviation of each pixel.

FIG. 5 illustrates an example of adjusting compensation gray levels of pixels during a compensation sub-frame to compensate for a luminance deviation of each pixel. More specifically, FIG. 5 illustrates that each of pixel data and compensation data is implemented with 8-bit data by way of example.

Referring to FIG. 5, the embodiment of the invention may control an operation of the display panel driver with reference to a luminance map shown in (A) of FIG. 5 during a compensation sub-frame CSF and adjust compensation gray levels of the pixels PXL as shown in (B) of FIG. 5 during the compensation sub-frame CSF, thereby compensating for a luminance deviation of each pixel as shown in (C) of FIG. 5.

More specifically, in the luminance map shown in (A) of FIG. 5, pixels P1, P7, P10, and P16 each have a luminance of 100 nit; pixels P2 and P12 each have a luminance of 70 nit; pixels P3, P9, and P15 each have a luminance of 85 nit; pixels P4 and P13 each have a luminance of 95 nit; pixels P5 and P14 each have a luminance of 75 nit; a pixel P6 has a luminance of 90 nit; and pixels P8 and P11 each have a luminance of 80 nit.

The embodiment of the invention may apply pixel data to all of the pixels P1 to P16 during a driving sub-frame DSF. The embodiment of the invention describes that the pixel data is applied to all of the pixels P1 to P16 at a maximum gray level of 255, but is not limited thereto. For example, the pixel data may be applied to at least some of the pixels P1 to P16 at different gray levels.

In this instance, the embodiment of the invention may apply compensation data of gray level "200" to each of the pixels P1, P7, P10, and P16, apply compensation data of gray level "255" to each of the pixels P2 and P12, apply compensation data of gray level "255" to each of the pixels P3, P9, and P15, apply compensation data of gray level "205" to each of the pixels P4 and P13, apply compensation data of gray level "245" to each of the pixels P5 and P14, apply compensation data of gray level "215" to the pixel P6, and apply compensation data of gray level "235" to each of the pixels P8 and P11 with reference to the luminance map shown in (A) of FIG. 5 during the compensation sub-frame CSF.

When the luminances of first and second pixels corresponding to the same gray level on the luminance map are different from each other as described above (for example, when a luminance of the first pixel is less than a luminance of the second pixel), the embodiment of the invention adjusts a compensation gray level of the first pixel to be greater than a compensation gray level of the second pixel during the compensation sub-frame CSF, thereby compensating for the luminances of all of the pixels P1 to P16 using a minimum luminance of the luminance map as shown in (C) of FIG. 5. The embodiment of the invention may increase a compensation luminance using a method of increasing a gamma power voltage applied to a gamma string of a data driving circuit, etc. as shown in (D) of FIG. 5.

Figure 6:
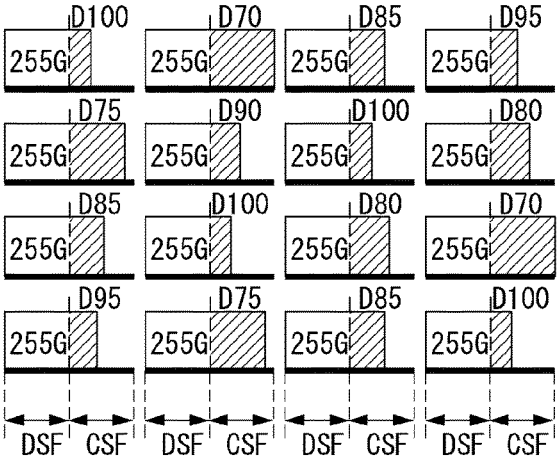
FIG. 6 illustrates an example of adjusting compensation duties of pixels during a compensation sub-frame to compensate for a luminance deviation of each pixel.

FIG. 6 illustrates an example of adjusting compensation duties of pixels during a compensation sub-frame CSF to compensate for a luminance deviation of each pixel. More specifically, FIG. 6 illustrates that each of pixel data and compensation data is implemented with 8-bit data by way of example.

Referring to FIG. 6, the embodiment of the invention may control an operation of the display panel driver with reference to a luminance map shown in (A) of FIG. 6 during a compensation sub-frame CSF and adjust compensation gray levels of the pixels PXL as shown in (B) of FIG. 6 during the compensation sub-frame CSF, thereby compensating for a luminance deviation of each pixel as shown in (C) of FIG. 6.

More specifically, in the luminance map shown in (A) of FIG. 6, pixels P1, P7, P10, and P16 each have a luminance of 100 nit; pixels P2 and P12 each have a luminance of 70 nit; pixels P3, P9, and P15 each have a luminance of 85 nit; pixels P4 and P13 each have a luminance of 95 nit; pixels P5 and P14 each have a luminance of 75 nit; a pixel P6 has a luminance of 90 nit; and pixels P8 and P11 each have a luminance of 80 nit.

The embodiment of the invention may apply pixel data to all of the pixels P1 to P16 during a driving sub-frame DSF. The embodiment of the invention describes that the pixel data is applied to all of the pixels P1 to P16 at a maximum gray level of 255, but is not limited thereto. For example, the pixel data may be applied to at least some of the pixels P1 to P16 at different gray levels.

In this instance, the embodiment of the invention may control an emission duty of each of the pixels P1, P7, P10, and P16 based on pixel data of gray level "255" to a first value D100, control an emission duty of each of the pixels P2 and P12 based on pixel data of gray level "255" to a second value D70, control an emission duty of each of the pixels P3, P9, and P15 based on pixel data of gray level "255" to a third value D85, control an emission duty of each of the pixels P4 and P13 based on pixel data of gray level "255" to a fourth value D95, control an emission duty of each of the pixels P5 and P14 based on pixel data of gray level "255" to a fifth value D75, control an emission duty of the pixel P6 based on pixel data of gray level "255" to a sixth value D90, and control an emission duty of each of the pixels P8 and P11 based on pixel data of gray level "255" to a seventh value D80 with reference to the luminance map shown in (A) of FIG. 6 during the compensation sub-frame CSF. The emission duty gradually shortens in the order of the second value D70, the fifth value D75, the seventh value D80, the third value D85, the sixth value D90, the fourth value D95, and the first value D100. In other words, the emission duty gradually lengthens in the order of the first value D100, the fourth value D95, the sixth value D90, the third value D85, the seventh value D80, the fifth value D75, and the second value D70.

When the luminances of first and second pixels corresponding to the same gray level on the luminance map are different from each other as described above (for example, when a luminance of the first pixel is less than a luminance of the second pixel), the embodiment of the invention adjusts a compensation duty of the first pixel to be longer than a compensation duty of the second pixel during the compensation sub-frame CSF, thereby compensating for the luminances of all of the pixels P1 to P16 using a minimum luminance of the luminance map as shown in (C) of FIG. 6. The embodiment of the invention may increase a compensation luminance using a method of increasing a gamma power voltage applied to a gamma string of a data driving circuit, etc. as shown in (D) of FIG. 6.

Figure 7:
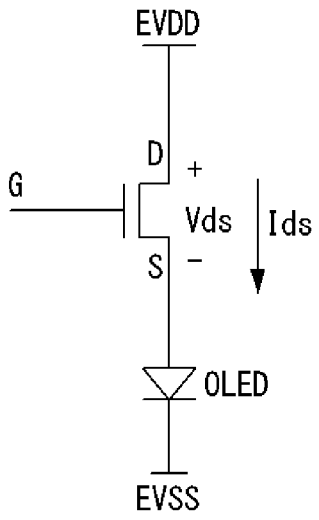
FIGS. 7 and 8 illustrate operating characteristics of a driving thin film transistor (TFT) in accordance with a high potential power source.
Figure 8:
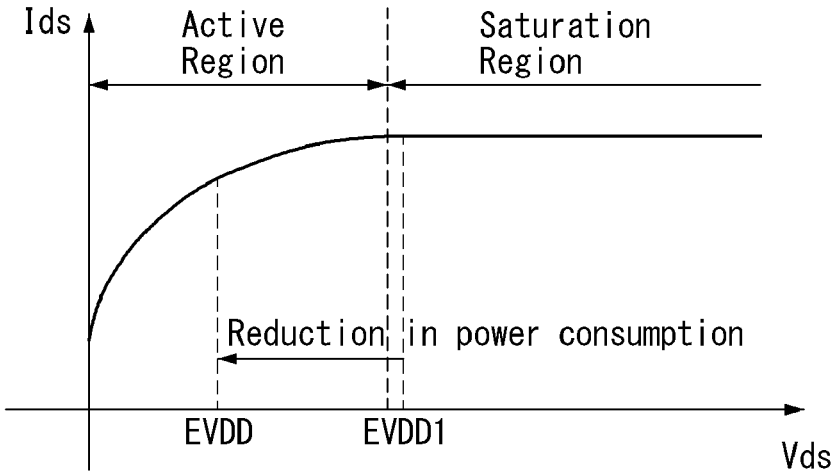
Figure 9:
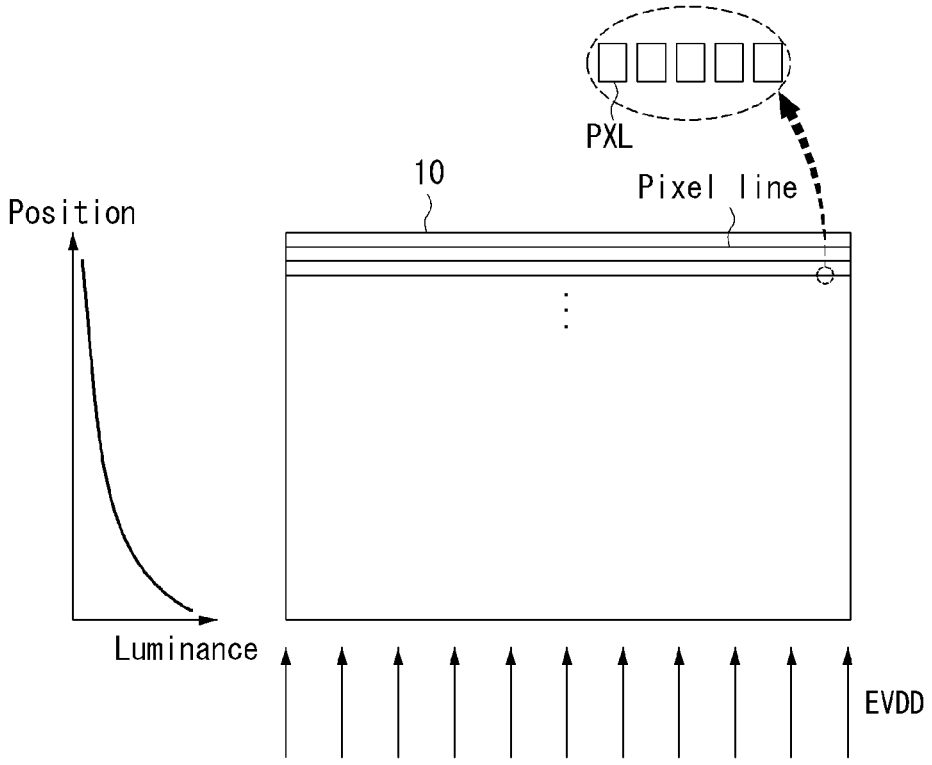
FIG. 9 illustrates that a luminance deviation is generated due to an IR drop depending on a location of a display panel.
Figure 10:
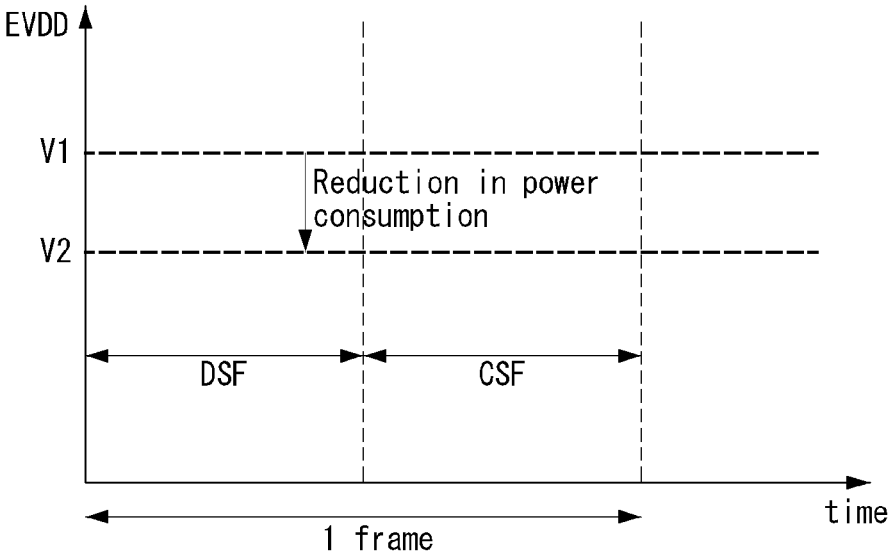
FIG. 10 illustrates an example of compensating for a luminance deviation between pixel lines resulting from an IR drop through a compensation sub-frame when a high potential power source exists in an active region of a driving TFT.

FIGS. 7 and 8 illustrate operating characteristics of a driving TFT connected to a high potential power source. FIG. 9 illustrates that a luminance deviation is generated due to an IR drop depending on a location of a display panel. FIG. 10 illustrates an example of compensating for a luminance deviation between pixel lines resulting from an IR drop during a compensation sub-frame when a high potential power source exists in an active region of a driving TFT.

Referring to FIG. 7, an OLED included in each pixel PXL receives a drain-to-source current Ids of a driving TFT DT and emits light. An amount of light emitted by the OLED is proportional to a magnitude of the drain-to-source current Ids. The drain-to-source current Ids is determined by a difference Vgs between a voltage applied to a gate electrode G of the driving TFT DT and a voltage applied to a source electrode S of the driving TFT DT. In each pixel PXL, a high potential power source EVDD is applied to a drain electrode D of the driving TFT DT, and a low potential power source EVSS is applied to a cathode electrode of the OLED.

The high potential power source EVDD may generally exist in a saturation region in Vds-Ids plane shown in FIG. 8. The saturation region indicates a voltage region, in which the drain-to-source current Ids does not substantially change in spite of changes in a drain-to-source voltage Vds of the driving TFT DT. When a power voltage is set in the saturation region as in a high potential power source EVDD1 shown in FIG. 8, the driving TFT DT is advantageous in operational stability. However, the driving TFT DT has a disadvantage of an increase in power consumption because of the high power voltage.

Hence, the embodiment of the invention is to reduce the power voltage for reducing power consumption, so that a voltage level of the high potential power source EVDD exists in an active region in the Vds-Ids plane shown in FIG. 8. In the embodiment disclosed herein, the active region indicates a voltage region, in which the drain-to-source current Ids changes depending on changes in the drain-to-source voltage Vds of the driving TFT DT.

However, when the power voltage is set in the active region as in the embodiment of the invention, which means the drain-to-source current Ids changes depending on a magnitude (i.e., the drain-to-source voltage Vds of the driving TFT DT) of the high potential power source EVDD in the active region as shown in FIG. 8, the embodiment of the invention is preferred to prepare a measure to compensate for a luminance deviation resulting from an IR drop.

The IR drop of the display panel 10 is generated by a line resistance of the high potential power source EVDD. As shown in FIG. 9, as the high potential power source EVDD is distanced away from the pixel line, an amount of IR drop increases. Because an increase in IR drop reduces a magnitude of the high potential power source EVDD applied to the pixel PXL, the luminance is reduced, and a line dim may be generated in the display panel 10 on a per pixel line basis.

In order to remove a luminance deviation of each pixel line resulting from such an IR drop, the embodiment of the invention previously stores a luminance deviation of each pixel line in a luminance map and controls an operation of a display panel driver during a compensation sub-frame CSF shown in FIG. 10. As a result, the embodiment of the invention can adjust compensation gray levels or compensation duties of the pixels PXL and can additionally compensate for a luminance deviation of each pixel line. As shown in FIG. 10, because the high potential power source EVDD exists in the active region, the power voltage is reduced from V1 to V2, and the power consumption is reduced by a reduction amount of the power voltage.

Figure 12:
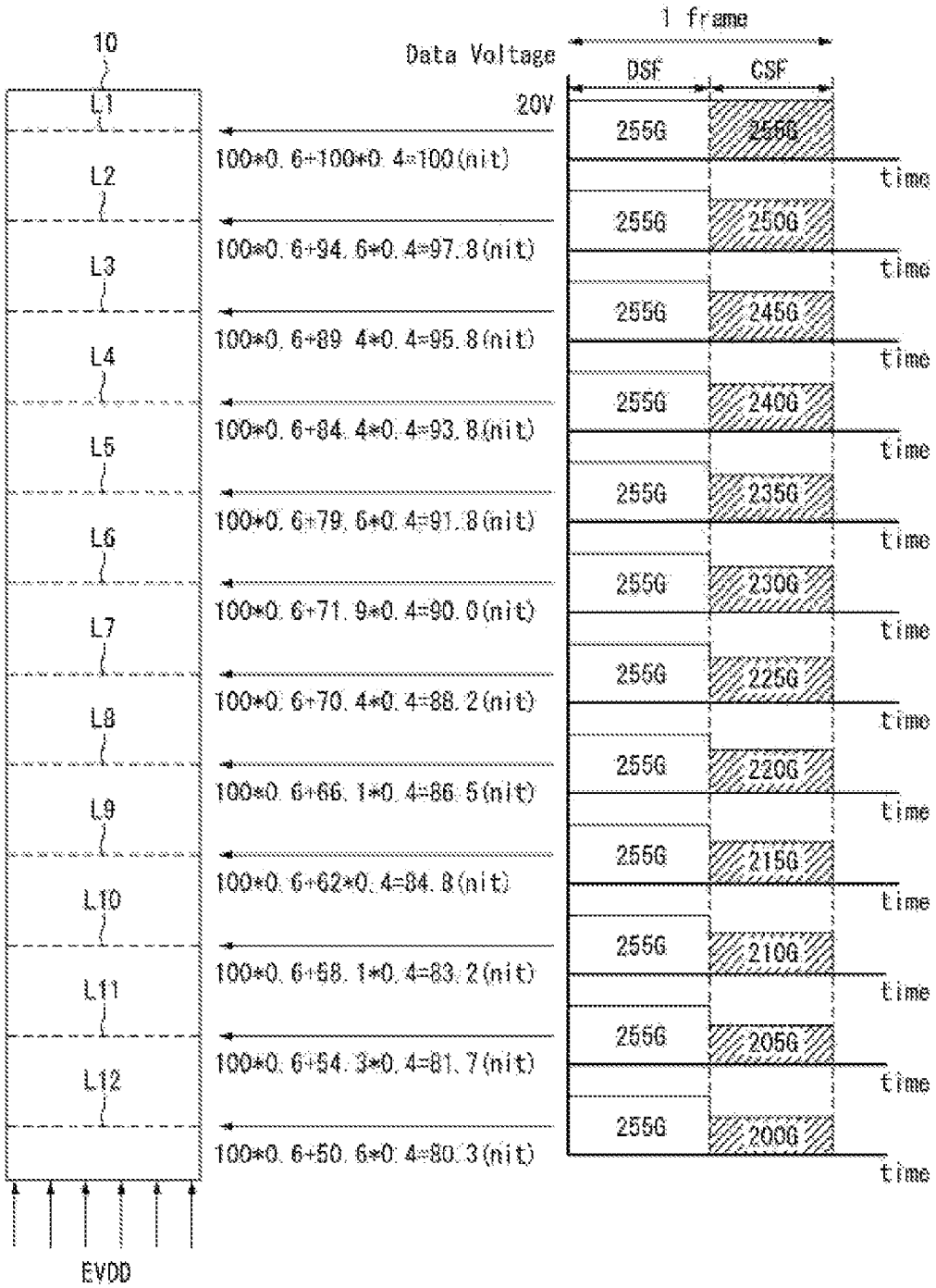
FIG. 12 illustrates an example of adjusting compensation gray levels of pixels during a compensation sub-frame, so as to compensate for a luminance deviation of each display line.
Figure 13:
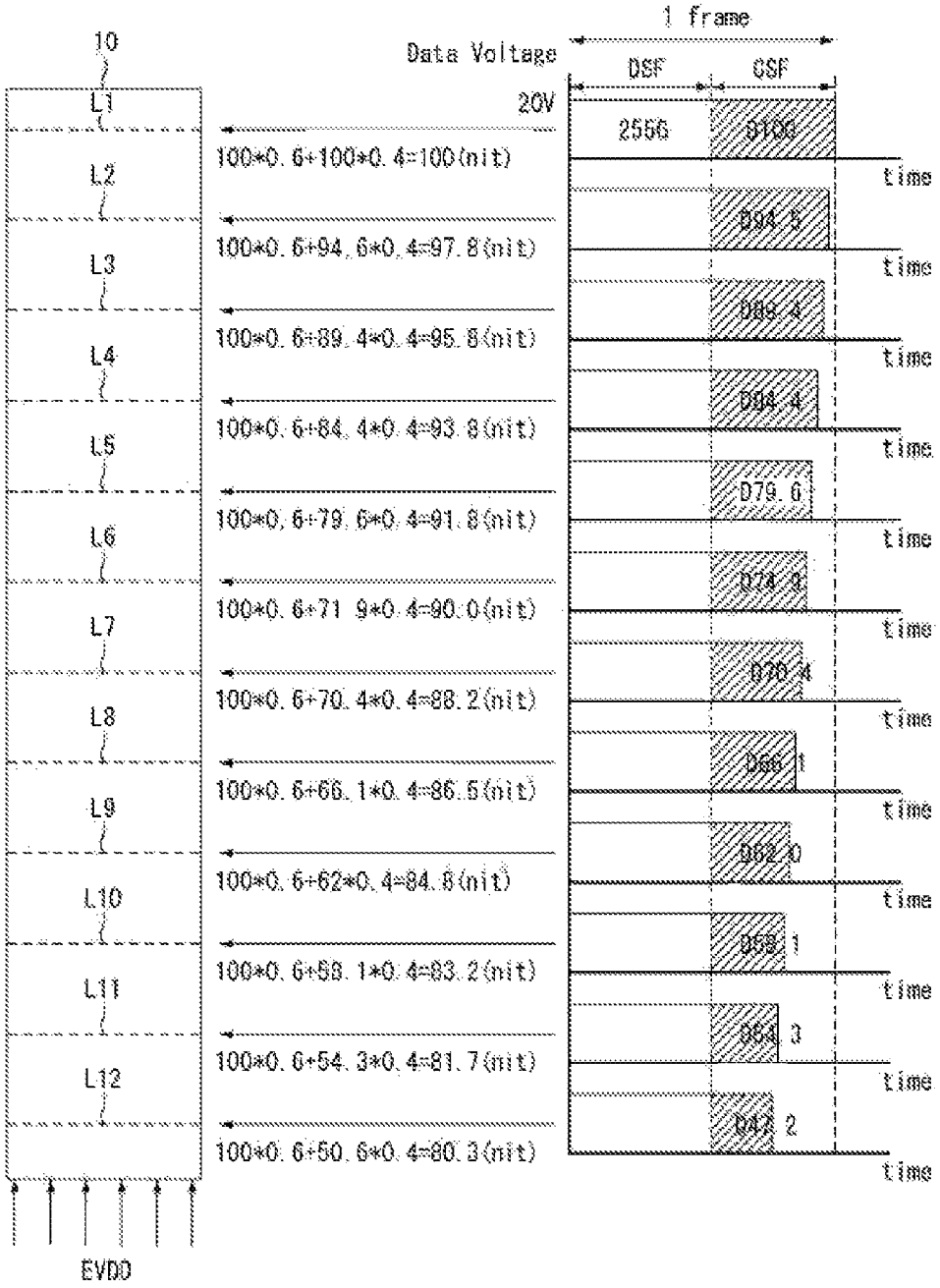
FIG. 13 illustrates an example of adjusting compensation duties of pixels during a compensation sub-frame, so as to compensate for a luminance deviation of each display line.

FIG. 11 illustrates a luminance map implemented in accordance with compensation gray levels. FIG. 12 illustrates an example of adjusting compensation gray levels of pixels during a compensation sub-frame, so as to compensate for a luminance deviation of each display line. FIG. 13 illustrates an example of adjusting compensation duties of pixels during a compensation sub-frame, so as to compensate for a luminance deviation of each display line.

Referring to FIGS. 11 and 12, when there are first and second pixel lines corresponding to the same gray level on the luminance map and a luminance of the first pixel line is less than a luminance of the second pixel line, the embodiment of the invention may additionally adjust a compensation gray level of the first pixel line to be greater than a compensation gray level of the second pixel line during the compensation sub-frame CSF so as to compensate for a luminance deviation of each pixel line resulting from an IR drop.

For example, when a driving sub-frame DSF and a compensation sub-frame CSF of one frame is set to a ratio of 6:4, the embodiment of the invention applies compensation data of gray level "200" to pixels PXL of a pixel line L12 closest to the high potential power source EVDD and applies compensation data of gray level "255" to pixels PXL of a pixel line L1 farthest from the high potential power source EVDD during the compensation sub-frame CSF. Because a separation distance between the pixel line and the high potential power source EVDD gradually increases as the pixel line changes from L11 to L2, the embodiment of the invention gradually increases a gray level of compensation data. Thus, the embodiment of the invention can reduce a luminance deviation of each pixel line resulting from an IR drop by applying compensation data of different gray levels to the pixel lines.

Referring to FIG. 13, when there are first and second pixel lines corresponding to the same gray level on the luminance map and a luminance of the first pixel line is less than a luminance of the second pixel line, the embodiment of the invention may additionally adjust a compensation duty of the first pixel line to be greater than a compensation duty of the second pixel line during the compensation sub-frame CSF, so as to compensate for a luminance deviation of each pixel line resulting from an IR drop.

For example, when a driving sub-frame DSF and a compensation sub-frame CSF of one frame is set to a ratio of 6:4, the embodiment of the invention controls an emission duty of pixels PXL on a pixel line L12 closest to the high potential power source EVDD to D47.2 and controls an emission duty of pixels PXL on a pixel line L1 farthest from the high potential power source EVDD to D100 during the compensation sub-frame CSF. Because a separation distance between the pixel line and the high potential power source EVDD gradually increases as the pixel line changes from L11 to L2, the embodiment of the invention gradually increases a compensation duty. Thus, the embodiment of the invention can reduce a luminance deviation of each pixel line resulting from an IR drop by applying different compensation duties to the pixel lines.

Figure 14:
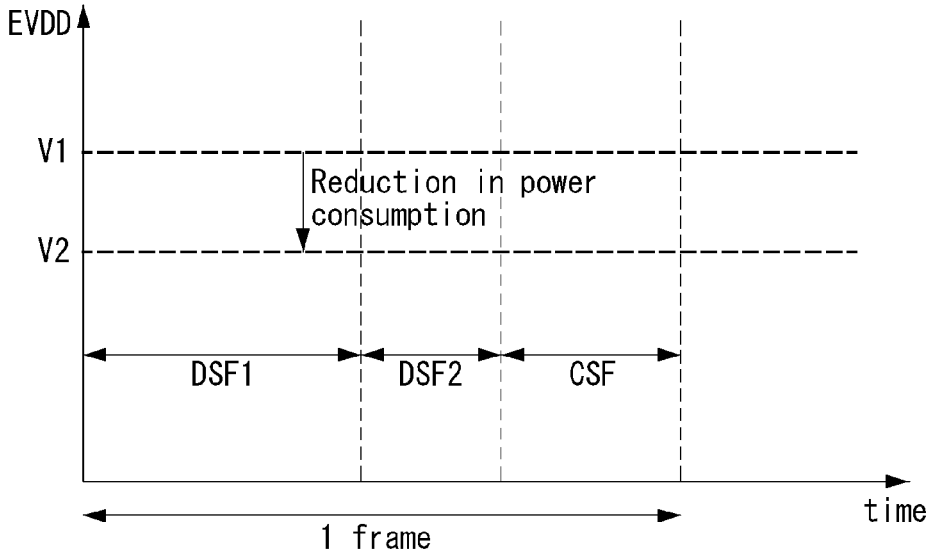
FIG. 14 illustrates an example where one frame includes a plurality of driving sub-frames to increase or maximize a gray level representation performance.
Figure 15:
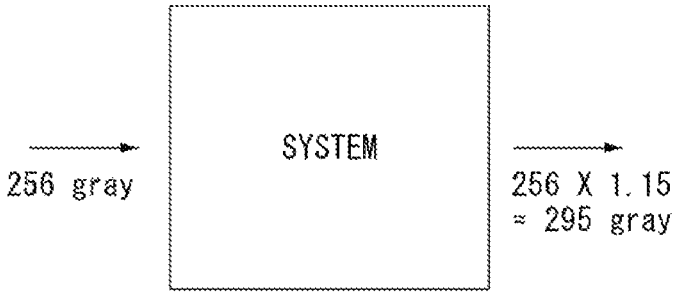
FIGS. 15 and 16 illustrate a number of representable gray levels and a gray level curve when a gray level representation performance increases by 15%.
Figure 16:
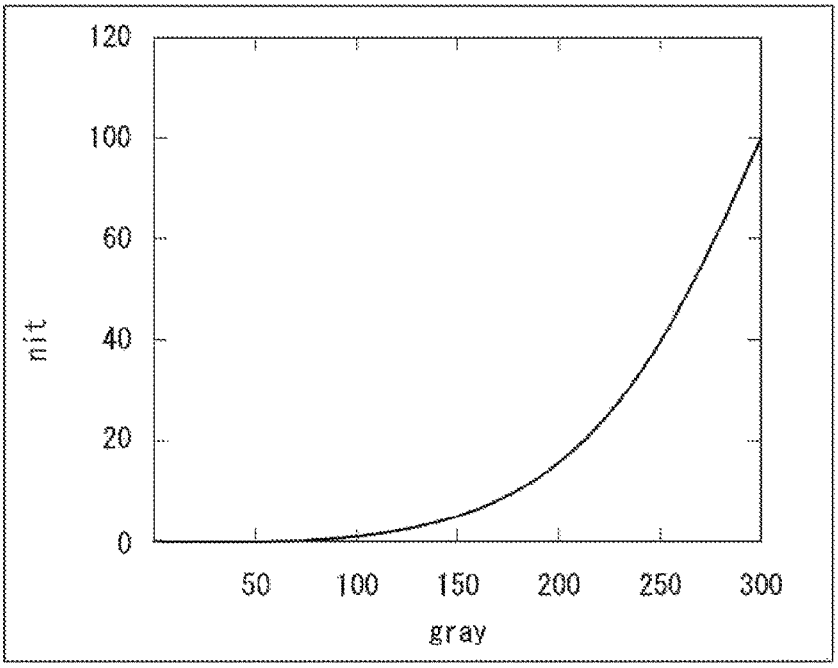

FIG. 14 illustrates an example where one frame includes a plurality of driving sub-frames to increase a gray level representation performance FIGS. 15 and 16 illustrate a number of representable gray levels and a gray level curve when a gray level representation performance increases by 15%.

Referring to FIG. 14, the embodiment of the invention assigns a plurality of driving sub-frames DSF1 and DSF2, in which pixel data is applied, to one frame, and thus can increase a number of representable gray levels with respect to the pixel data and increase a gray level representation performance.

When pixel data is 8-bit data, the number of representable gray levels depending on the number 'k' of driving sub-frames is "$256*(2^k-1)$". For example, as shown in FIG. 14, the number 'k' of driving sub-frames is two, the number of representable gray levels is 256*3 (DSF1, DSF2=on, on) (DSF1, DSF2=on, off) (DSF1, DSF2=off, on).

In this instance, as shown in FIG. 15, with gray level representation performance increased by 15%, when gray levels are mapped at a luminance closest to gray level "295" among 768 representable gray levels, a gray level curve shown in FIG. 16, in which an average error of each gray level is 0.77%, may be obtained. As a result, the embodiment of the invention can increase or maximize gray level representation performance by controlling a number of driving sub-frames in one frame.

As described above, an embodiment of the invention may efficiently compensate for a luminance deviation of each pixel by adjusting compensation gray levels or compensation duties of pixels through a compensation sub-frame included in one frame.

Also, an embodiment of the invention may reduce a power voltage level so that a voltage level of a high potential power source exists in an active region of a Vds-Ids plane, and thus can reduce power consumption. The embodiment of the invention may adjust compensation gray levels or compensation duties of pixels through a compensation sub-frame included in one frame, and thus may additionally compensate for a luminance deviation of each pixel line resulting from an IR drop.

Moreover, an embodiment of the invention may increase a number of representable gray levels with respect to pixel data and increase a luminance representation performance by assigning a plurality of driving sub-frames, in which pixel data is applied, to one frame.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode (OLED) display comprising:

a display panel including a plurality of gate lines and a plurality of data lines crossing each other to define a plurality of pixels, each pixel including a driving transistor, a switching transistor, an OLED and a storage capacitor;

a timing controller that receives pixel data of an input image and timing signals and time-divides a period of one frame into at least a driving sub-frame and a compensation sub-frame based on one or more of the timing signals; and a display panel driver that converts the pixel data into data voltages and supplies the data voltages to the plurality of data lines during the driving sub-frame, and that adjusts compensation gray levels of the plurality of pixels or compensation duties of the plurality of pixels based on a luminance map, which contains information on a luminance deviation for each pixel with respect to a same gray level, during the compensation sub-frame, wherein each gate line includes a scan control line and an emission control line, wherein the emission control line is connected to a second switching transistor, and wherein when the second switching transistor is turned on in response to an emission control signal, a low potential power source is electrically connected to an electrode of the storage capacitor, and wherein the display panel driver adjusts compensation duties of the plurality of pixels by controlling a production timing of the emission control signal supplied to the emission control line of each gate line on a per pixel basis or a per pixel line basis.

2. The OLED of claim 1, further comprising a memory that stores the luminance map, wherein the timing controller includes the luminance map, and wherein the display panel driver includes a data driver and a gate driver.

3. The OLED of claim 1, wherein the timing controller generates compensation data based on the pixel data and the luminance map, and wherein the display panel driver converts the compensation data into compensation voltages and supplies the compensation voltages to the plurality of data lines during the compensation sub-frame.

4. The OLED of claim 3, wherein the compensation voltages adjust the compensation gray levels of the plurality of pixels on a per pixel basis or a per pixel line basis.

5. The OLED of claim 4, wherein the compensation voltages are within a range of voltages that causes a current to flow between source and drain electrodes of the driving transistor.

6. The OLED of claim 1, wherein the timing controller generates black data based on the pixel data and the luminance map, and wherein the display panel driver converts the black data into black voltages and supplies the black voltages to the plurality of data lines during the compensation sub-frame.

7. The OLED of claim 6, wherein the black voltages adjust the compensation gray levels of the plurality of pixels on a per pixel basis or a per pixel line basis.

8. The OLED of claim 7, wherein the black voltages are within a range of voltages that causes a current not to flow between source and drain electrodes of the driving transistor.

9. The OLED of claim 1, wherein emission control lines of the plurality of gate lines are individually, electrically connected to the plurality of pixels to control the compensation duties thereof on a per pixel basis.

10. The OLED of claim 1, wherein emission control lines of the plurality of gate lines are commonly, electrically connected to pixels on a same pixel line to control the compensation duties thereof on a per pixel line basis.

11. The OLED of claim 1, wherein the luminance map contains information updated based on changes in electrical characteristics of the driving transistor and the OLED.

12. The OLED of claim 1, wherein the luminance map contains information on a luminance deviation resulting from difference in an amount of IR drop on a per pixel line basis.

13. The OLED of claim 12, wherein the amount of IR drop varies depending on a separation distance between a high potential power source and a corresponding pixel line.

14. The OLED of claim 13, wherein as the separation distance increases, an amount of adjustment of the compensation gray levels or the compensation duties of pixels on the corresponding pixel line increases.

15. The OLED of claim 1, wherein the compensation gray levels of the plurality of pixels or the compensation duties of the plurality of pixels are further adjusted by varying a gamma power voltage applied to a data driver of the display panel driver.

16. The OLED of claim 1, wherein a high potential power voltage is set in an active region in a Vds-Ids plane of the driving transistor.

17. The OLED of claim 1, wherein the timing controller time-divides a period of one frame into at least two driving sub-frames and a compensation sub-frame to increase a gray level representation performance.

* * * * *